US007047768B2

(12) United States Patent
Miyai

(10) Patent No.: US 7,047,768 B2
(45) Date of Patent: May 23, 2006

(54) TUBULAR KNIT FABRIC AND METHOD OF KNITTING THE SAME

(75) Inventor: Takuya Miyai, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/525,968

(22) PCT Filed: Aug. 26, 2003

(86) PCT No.: PCT/JP03/10811

§ 371 (c)(1),
(2), (4) Date: Feb. 28, 2005

(87) PCT Pub. No.: WO2004/020718

PCT Pub. Date: Mar. 11, 2004

(65) Prior Publication Data

US 2005/0247083 A1 Nov. 10, 2005

(30) Foreign Application Priority Data

Aug. 28, 2002 (JP) ..... 2002-249289

(51) Int. Cl.
*D04B 7/04* (2006.01)

(52) U.S. Cl. ..... 66/64; 66/174

(58) Field of Classification Search ..... 66/60 R, 66/64, 65, 69, 174
See application file for complete search history.

(56) References Cited

U.S. PATENT DOCUMENTS

| | | | | |
|---|---|---|---|---|
| 3,788,103 | A * | 1/1974 | Asai | 66/65 |
| 3,916,647 | A * | 11/1975 | Yabuta | 66/65 |
| 5,239,846 | A * | 8/1993 | Kitaura et al. | 66/174 |
| 6,651,462 | B1 * | 11/2003 | Okamoto | 66/64 |
| 6,655,175 | B1 * | 12/2003 | Okamoto | 66/69 |
| 6,658,899 | B1 * | 12/2003 | Okamoto | 66/64 |

FOREIGN PATENT DOCUMENTS

| | | |
|---|---|---|
| EP | 1 270 782 | 1/2003 |
| EP | 1 283 290 | 2/2003 |
| JP | 9-188945 | 7/1997 |
| JP | 10-140446 | 5/1998 |
| JP | 1-124757 | 5/1999 |
| JP | 11-152656 | 6/1999 |
| WO | 02/070800 | 9/2002 |

* cited by examiner

*Primary Examiner*—Danny Worrell
(74) *Attorney, Agent, or Firm*—Wenderoth, Lind & Ponack, L.L.P.

(57) ABSTRACT

A knitting method of a tubular knit fabric uses a flat-knitting machine comprising at least one pair of facing needle beds that extend in the sideways direction and face each other front to back. At least one of the facing needle beds is capable of racking in the sideways direction, and the flat-knitting machine is capable of transferring stitches between facing needle beds. The tubular portion with directionality toward (oriented with respect to) another tubular portion is turned by a predetermined amount by transferring of stitches of the tubular portion with directionality and by racking of the needle bed. Knitting is performed so as to link the tubular portion with directionality to the other tubular portion in a state wherein the state of being turned is sustained.

4 Claims, 6 Drawing Sheets

BB
FB
8a
8
5
91a
7
1
2
3
4
91b 92
93b
93
93a

TUBULAR KNIT FABRIC AND METHOD OF KNITTING THE SAME

TECHNICAL FIELD

The present invention relates to a knitting method of tubular knit fabric using a flat-knitting machine, wherein stitches can be transferred between facing needle beds, and multiple tubular portions that have differing purposes are connected by knitting together. The flat-knitting machine comprises at least one pair of facing needle beds that extend in the sideways direction and face in the opposing direction, and racking in the sideways direction can be performed by at least one of the facing needle beds.

BACKGROUND ART

In general, a sweater or glove is comprised of multiple tubular portions with differing purposes that are connected by knitting together. For example, a sweater is comprised of sleeve portions and a bodice portion that are connected by knitting together, wherein the sleeve portions and the bodice portion are knitted in a tube form. Further, a glove is comprised of finger tubes, a four-finger tube, and a five-finger tube, knitted in a tube form, wherein the finger tubes other than the thumb tube are connected by knitting together to the four-finger tube, and the thumb tube and the four-finger tube are connected by knitting together to the five-finger tube.

Further, in the case of knitting a knit garment such as a sweater or a glove with a flat-knitting machine, conventionally, each tubular portion is knitted in a tube form by placing the front side knitting portion on the front needle bed of the flat-knitting machine, and placing the back side knitting portion on the back needle bed.

Now, in the case of knitting a knit garment such as a sweater on a flat knitting frame, conventionally, the front bodice and the front sleeves are knit together on the front needle bed, and the back bodice and the back sleeves are knit together on the back needle bed, and each tubular knit fabric is continuously knit together seamlessly.

The present inventor has invented a knit garment wherein a glove is continuously knit to the sleeve portion of the knit garment, but has noticed that in the case of continuously knitting the glove to the sleeve portion of the knit garment, the glove is conventionally formed from knit fabric wherein the palm side is knit on one of the needle beds and the side of the back of the hand of the glove is knit on the other needle bed. Therefore, whereas the thumb on a human body faces the front side of the body and the little finger faces the back side of the body, if a glove is continuously knit onto a sleeve portion after the glove has been knit, the resulting knit garment will be formed with the thumb and the little finger on the far ends in the width direction of the body, and therefore will be in a form that does not match the configuration of the body.

Further, in the case of a glove, for example a general work glove, the majority of gloves that are continuously knit together with tubular fingers and a four-finger tube and a five-finger tube are the type that can be used for either the left or right hand, and therefore, as illustrated in FIG. 7, the glove is knit so that the fingers of the little finger 1, the ring finger 2, the middle finger 3, the index finger 4, and the thumb 5, and the five-finger tube knit portions are flat and are similar for the back of the hand or the palm.

However, the construction of an actual human hand is such that the direction of the thumb-tip and the direction of the nail of the thumb differs from the direction of the fingertips and the direction of the nails of the little finger, the ring finger, the middle finger, and the index finger, and further, the palm is such that the base portion that attaches the thumb to the entire palm is further forward into the palm side, and the thumb is positioned further forward than the other fingers. Therefore, with a glove configured as described above in a flat shape, the shape of the glove differs from the shape of the hand, and therefore when the glove is worn, the knot portion Y on both edges of the fingertip curve line X that is formed at the beginning of knitting of the thumb tube for thumb 5 coincides with the underside of the thumb, and wearing the glove may become uncomfortable, and work efficiency may decrease.

SUMMARY OF THE INVENTION

Accordingly, it is an object of the present invention to provide a tubular knit fabric and a knitting method thereof wherein discomfort can be eliminated during wearing, by shaping the overall shape of the tubular knit fabric to match that of the configuration of the human body.

The invention of the knitting method of the tubular knit fabric of the present invention uses a flat-knitting machine comprising at least one pair of facing needle beds that extend in the sideways direction and face each other front to back. At least one of the facing needle beds is capable of racking in the sideways direction, and the flat-knitting machine is capable of transferring stitches between facing needle beds. The tubular portion with directionality toward a predetermined tubular portion is turned by a predetermined amount by transferring of stitches of the tubular portion with directionality and by racking of the needle bed, in which the stitch of the tubular portion with directionality that is farthest from the predetermined tubular portion is transferred so that the tubular portion with directionality turns into the predetermined tubular portion, following which knitting is performed so as to link the tubular portion with directionality to the predetermined tubular portion in a state wherein the state of being turned is sustained. Therefore, the overall shape of the tubular fabric is shaped to match the configuration of a human body.

According to the present invention, simply by turning the predetermined tubular portions to match the configuration of a human body before linking the various tubular portions, the tubular knit fabric can be knit together in the shape that matches the configuration of a human body, and a more comfortable fit when wearing the tubular knit fabric can be obtained.

Further, with the above-described knitting method of a tubular knit fabric, with regard to a knit garment comprising glove portions and sleeve portions and a bodice portion, the glove portions and the sleeve portions and the bodice portion are continuously knit after performing a turning operation so that the thumb of the glove faces the front side of the body after completion of the knit garment, by the racking operation of the needle bed and the transferring of the stitch immediately following the knitting of the glove portion to an empty needle.

According to this method, the state of the glove portion facing the bodice portion can be set to the state matching the configuration of a human body, and a better fit and greater comfort when wearing the knit garment can be obtained.

Further, with a glove according to the present invention comprising four fingers and one thumb of knit fabric, before connecting the four fingers and the one thumb, the thumb is turned in the range of one quarter turn or less by the racking operation of the needle bed and the transferring of the stitches of which the thumb has been knit to empty needles, following which the four fingers and the thumb are connected, thereby knitting so as to connect the four fingers and the thumb to a five-finger tube.

According to this configuration, by the turning operation of the thumb tube, the knot portion on both edges of the fingertip curve line that is formed at the beginning of knitting of the thumb tube for the thumb does not coincide with the underside of the thumb when the glove is worn, and the thumb tube of the glove can be shaped to match the shape of the thumb on a human hand. Therefore, any discomfort while wearing the glove is eliminated, and productivity can be increased.

Now, the turning operation of the thumb is most preferable in the range of three-twentieths of a turn to one-quarter of a turn, from the state prior to connecting the four-finger tube and the thumb tube, in the direction in which the stitch on the thumb tube that is farthest from the four-finger tube turns toward the palm.

Further, with the tubular knit fabric of the present invention, multiple tubular portions are knitted and connected, using a flat-knitting machine comprising at least one pair of facing needle beds that extend in the sideways direction and face each other front to back, wherein at least one of the facing needle beds is capable of racking in the sideways direction, and the flat-knitting machine is capable of transferring stitches between facing needle beds.

The tubular portion with directionality toward a predetermined tubular portion is turned by a predetermined amount by transferring of stitches of the tubular portion with directionality and by racking of the needle bed. The stitch of the tubular portion with directionality that is farthest from the predetermined tubular portion is transferred so that the tubular portion with directionality turns into the predetermined tubular portion, following which knitting is performed so as to link the tubular portion with directionality to the predetermined tubular portion in a state wherein the state of being turned is sustained. Therefore, the overall shape of the tubular fabric is shaped to match the configuration of a human body.

According to this configuration, the tubular knit fabric matches the shape of a human body, and therefore a better fit when wearing the knit garment can be obtained.

DETAILED DESCRIPTION OF THE INVENTION

Embodiments of the tubular knit fabric and the knitting method thereof according to the present invention will be described below, according to the drawings.

A first embodiment is a tubular knit fabric of a knit garment, and a second embodiment is a tubular fabric of a five-fingered glove. Further, a knit garment or a glove is knit together using a flat-knitting machine with two beds that comprises one pair of facing needle beds that extend in the sideways direction and face one another, are capable of racking in the sideways direction, and are further capable of transferring stitches between the facing needle beds.

In the case of knitting together a tubular knit fabric, the knitting is performed on a two bed flat-knitting machine, using every other needle on each of the front and back needle beds (beds). For example, the odd-numbered needles of the front needle bed may be mainly used for knitting the fabric of the back bodice portion of the knit garment and the palm side portion of the glove, and the even-numbered needles of the back needle bed may be mainly used for knitting the fabric of the front bodice portion of the knit garment and the back of the hand side portion of the glove.

Further, the front and back needle beds have empty needles on one needle bed that each face a needle used for knitting on the other needle bed, and these empty needles are used for transferring stitches or knitting a rib.

By using such empty needles, systematic patterns wherein the front stitch and the back stitch are mixed, such as links, garters, and ribbing, can be knit together, and the stitches can be moved in the course direction and connect one another together.

Further, in the case in which a two bed flat-knitting machine is used, the knit fabric can be knit together by providing a transfer jack bed wherein transfer jacks are arrayed on the upper portion of one or both of the front and back needle beds.

Now, according to the present embodiment, a flat-knitting machine with two beds is used to knit together a knit garment or a glove, but the present invention can also use a four-bed flat-knitting machine formed from an upper front needle bed, a lower front needle bed, an upper back needle bed, and a lower back needle bed, to knit.

In the case of using a four-bed flat-knitting machine, for example, the front side knit fabric can be knit with the lower front needle bed and the upper back needle bed, and the back side knit fabric can be knit with the lower back needle bed and the upper front needle bed. In the instance of knitting the front side knit fabric, all of the loops of the back side knit fabric are retained on the lower back needle bed, and in the instance of knitting the back side knit fabric, all of the loops of the front side knit fabric are retained on the lower front needle bed.

Figure 1:
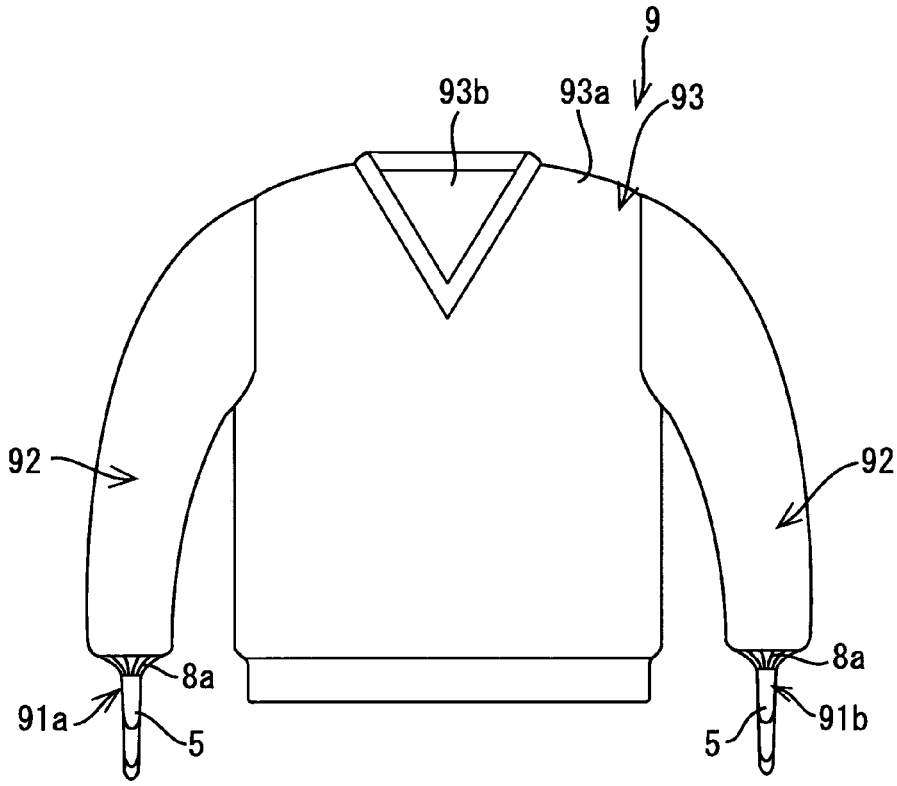
FIG. 1 is a diagram of a tubular knit fabric of a knit garment according to a first embodiment of the present invention, and is a diagram illustrating the knit garment from the front bodice side.
Figure 2:
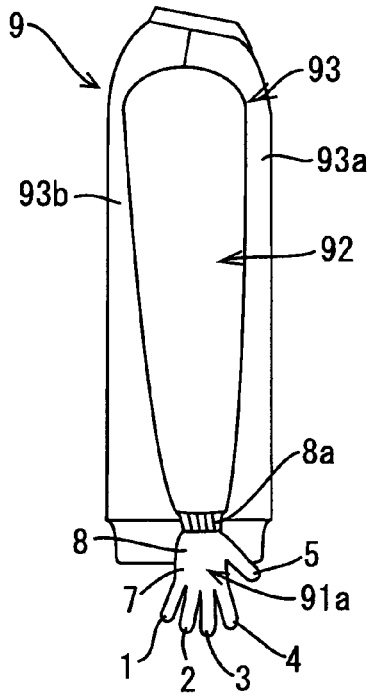
FIG. 2 is a diagram of a tubular knit fabric of a knit garment according to the first embodiment of the present invention, and is a diagram illustrating the knit garment from the side.
Figure 3:
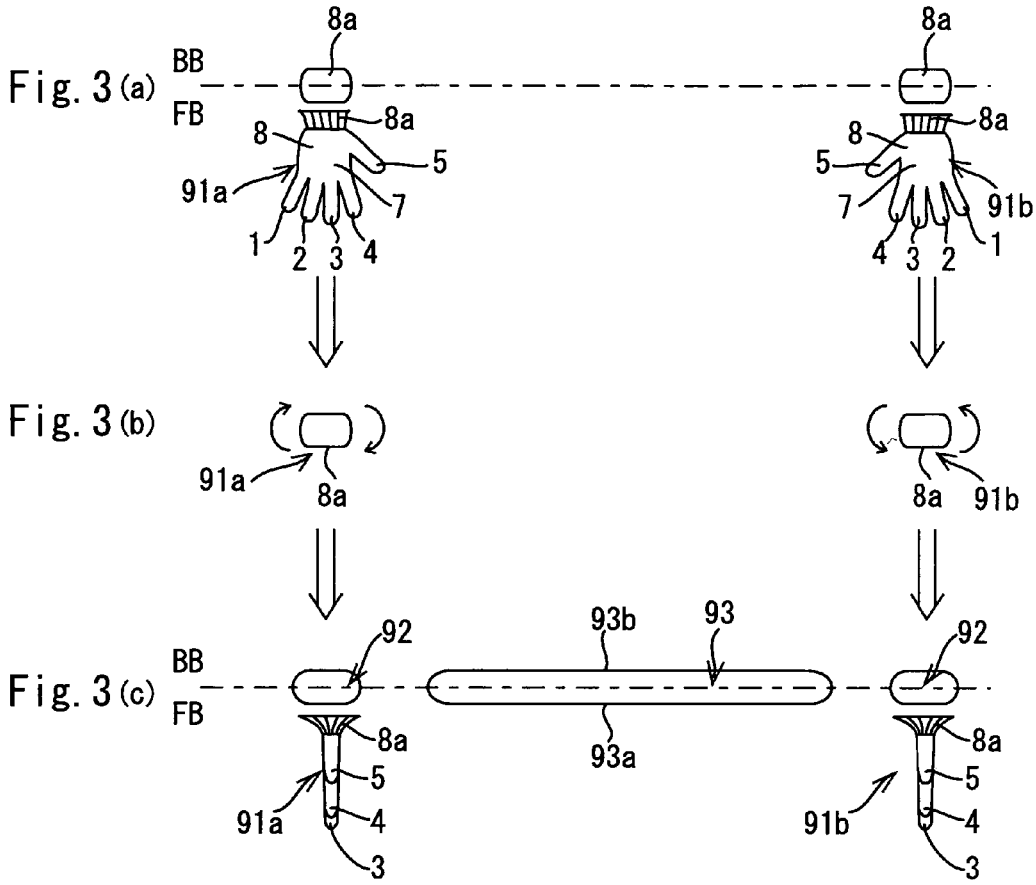
FIG. 3 is a knitting process diagram illustrating the knitting order for knitting together the knit garment of the first embodiment.

The first embodiment is illustrated in FIG. 1 through FIG. 3. The tubular fabric of the first embodiment is a knit garment 9 comprising glove portions 91*a* and 91*b*, and sleeve portions 92 and a bodice portion 93. As illustrated in FIGS. 1 and 2, the glove portions 91*a* and 91*b* have directionality (have a specific orientation) corresponding to the sleeve portions 92 and the bodice portion 93.

With the first embodiment, after performing the turning operation in the range of one-quarter turn so that the thumb tube faces the front face side of the body after the knit garment 9 has been completed by the transferring of the stitch immediately following these glove portions 91*a* and 91*b* being knit together onto the empty needle and the racking operation of the needle bed, the sleeve portions 92 are continuously knit together to the glove portions 91*a* and 91*b*. By connecting the sleeve portions 92 to the bodice portion 93, and as illustrated in FIG. 1 and FIG. 2, when the knit garment 9 is completed, the thumb tube 5 of the glove portions 91*a* and 91*b* are positioned on the side of the front bodice 93*a*, and the finger tubes of the little finger 1 are positioned on the side of the back bodice 93*b*.

The knitting method of the knit garment 9 of the first embodiment will be described based on FIG. 3. First, as illustrated in FIG. 3(*a*), the right hand glove portion 91*a* and the left hand glove portion 91*b* are knit from the fingertip side.

Each glove portion 91*a* and 91*b* comprises finger tubes for a little finger 1, a ring finger 2, a middle finger 3, an index finger 4, and a thumb 5, a four-finger tube 7, a five-finger tube 8, and a wrist portion 8*a*, and are knit on the needle bed so that the thumb 5 is positioned on the side of the bodice portion 93. In the present embodiment, the knit fabric for the palm side is knit on the front needle bed (FB), and the knit fabric for the back side is knit on the back needle bed (BB).

Further, after the wrist portion 8*a* of the glove portions 91*a* and 91*b* have been completely knit together, as illustrated in FIG. 3(*b*), the thumb tube of the thumb 5 is turned in the range of one-quarter turn or less (turned in the direction of the arrows in FIG. 3(*b*)) so as to face (be located at) the front face side of the knit garment 9, by the transferring of the stitch immediately following the knitting together onto the empty needle, and the racking operation of the needle bed. With the present embodiment, a one-quarter turn is performed.

After the turning operations of the glove portions 91*a* and 91*b* are completed, as illustrated in FIG. 3(*c*), the sleeve portions 92 are continuously knit onto the wrist portions 8*a* of the glove portions 91*a* and 91*b*. At this time, the bodice portions 93 are knit simultaneously but separately from the sleeve portions 92.

The bodice portions 93 and the sleeve portions 92 are connected with a known seamless knitting method that has been used conventionally, and the knit garment 9 is completed by connecting the shoulder portions of the bodice portions 93 using a welt seam process and knitting together the neckline.

As shown above, the glove portions 91*a* and 91*b* are knit continuously on the tips of the sleeve portions 92 of the knit garment 9 of the first embodiment. These glove portions 91*a* and 91*b*, as illustrated in FIG. 2, are in the state of being positioned so that the thumb tube 5 is positioned on the side of the front bodice 93*a*, and the finger tube of the little finger 1 is positioned on the side of the back bodice 93*b* when the knit garment 9 has been completed, and therefore a knit garment 9 can be shaped to match the configuration of a human body.

As a result, the knit garment 9 can fit well to the body when worn, and comfort of wearing is improved.

Now, with the above-described embodiment, the turning operation is performed at the time of completion of the knitting of the wrist portions 8*a* of the glove portions 91*a* and 91*b*, but the turning operation can be performed at the point that the five-finger tube 8 is completely knit, and the wrist portions 8*a* can be knit with a rib pattern.

Thus, by performing the turning operation at the part of the tube portion that is switched from the glove portions 91*a* and 91*b* to the sleeve portions 92, or by performing the turning operation at the portion that the knitting pattern switches when the wrist portions 8*a* are knit together using a rib knit pattern and so forth, the stitches that are twisted by the transferring between the front and back beds in the instance of the turning operation are made less conspicuous.

Further, in the case that the twisted stitches are conspicuous, during the last procedure immediately prior to the turning operation, the stitch to be twisted by the turning operation can be formed as a stitch twisted in the opposite direction from the twisting direction.

Further, according to the above-described first embodiment, the turning operation is performed continuously from the point wherein the wrist portion 8*a* is knit completely until the thumb tube is facing (located at) the front face side of the body. However, the turning operation can be performed after completing the knitting of the wrist portion 8*a*, and until the connection of the front and back bodices 93*a* and 93*b* is started, and the turning operation and the knitting of the sleeve portions 92 can also be performed in parallel.

Next, the second embodiment will be described. The tubular fabric of the second embodiment is a glove, and using the above-described two-bed flat-knitting machine, the finger tubes of the little finger, the ring finger, the middle finger, the index finger, and the thumb, and the four-finger tube to which the little finger, the ring finger, the middle finger, and the index finger are connected, and the five-finger tube to which is connected the four-finger tube and the thumb tube, are knit together seamlessly so as to have a continuous tube with no seams.

The glove of the second embodiment has directionality of the thumb corresponding to (i.e., with respect to) the four-finger tube. According to the second embodiment, regarding the connection between the thumb tube and the four-finger tube to which the little finger, the ring finger, the middle finger, and the index finger are inserted, prior to connecting the four-finger tube and the thumb tube that has directionality with respect to the four-finger tube, the four-finger tube and the thumb tube are connected after performing the turning operation within the range of one-quarter turn or less by the transferring of the stitch immediately following the knitting of the finger tube onto an empty needle and the racking operating of the needle bed, and the four-finger tube and the thumb tube are continuously knit to the five-finger tube. Therefore, the entire glove can be shaped to match the shape of a human hand.

Figure 4:
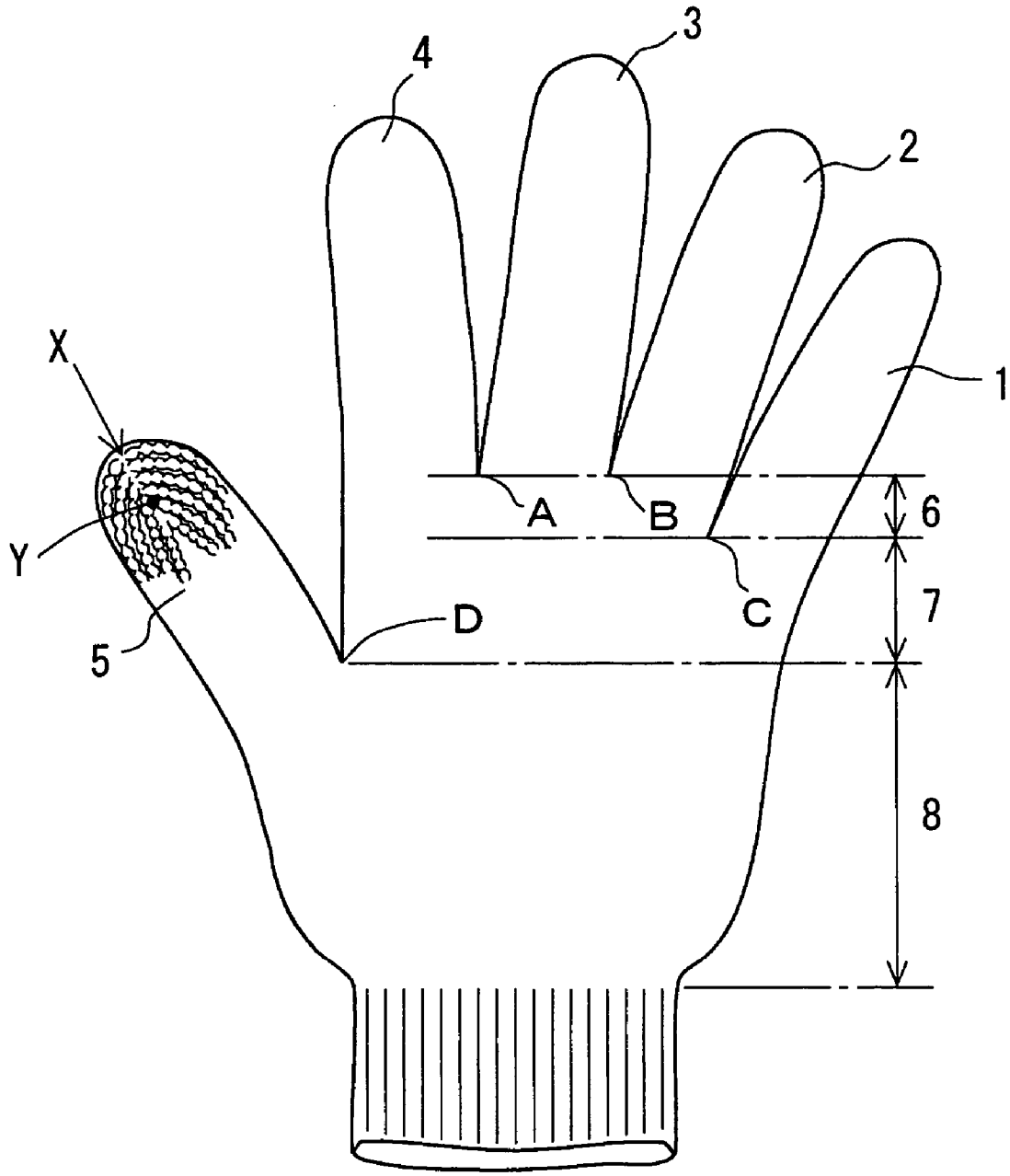
FIG. 4 is a diagram of a tubular knit fabric of a glove according to a second embodiment of the present invention, and is a diagram illustrating from the palm side the state wherein the thumb is unbent.
Figure 5:
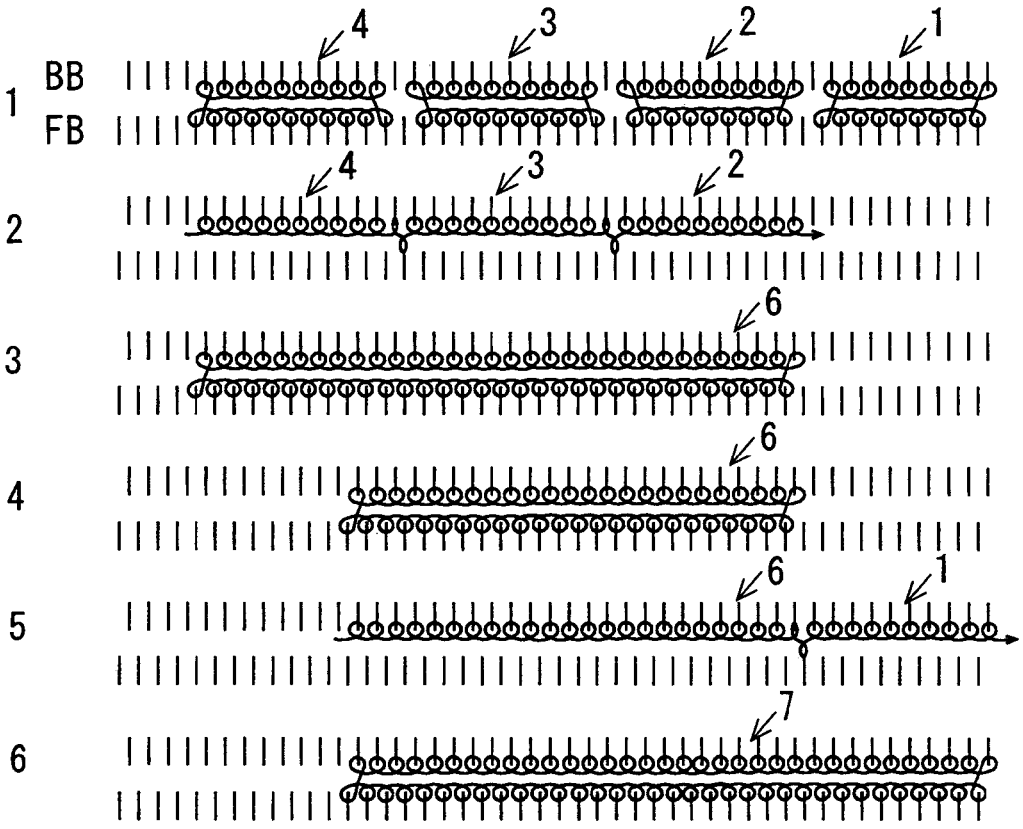
FIG. 5 is a knitting process diagram illustrating the knitting order for knitting together the glove of the second embodiment.
Figure 6:
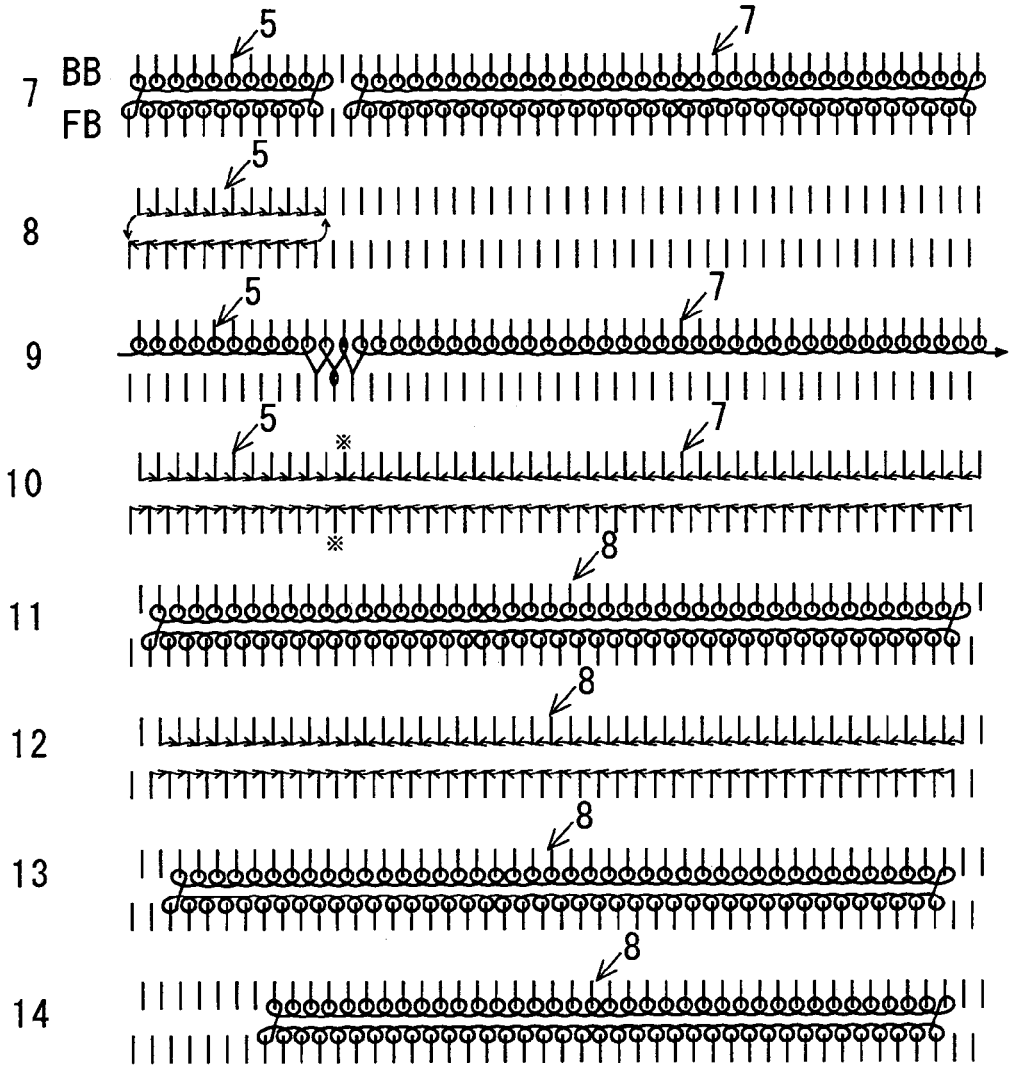
FIG. 6 is a knitting process diagram illustrating the knitting order for knitting together the glove of the second embodiment.
Figure 7:
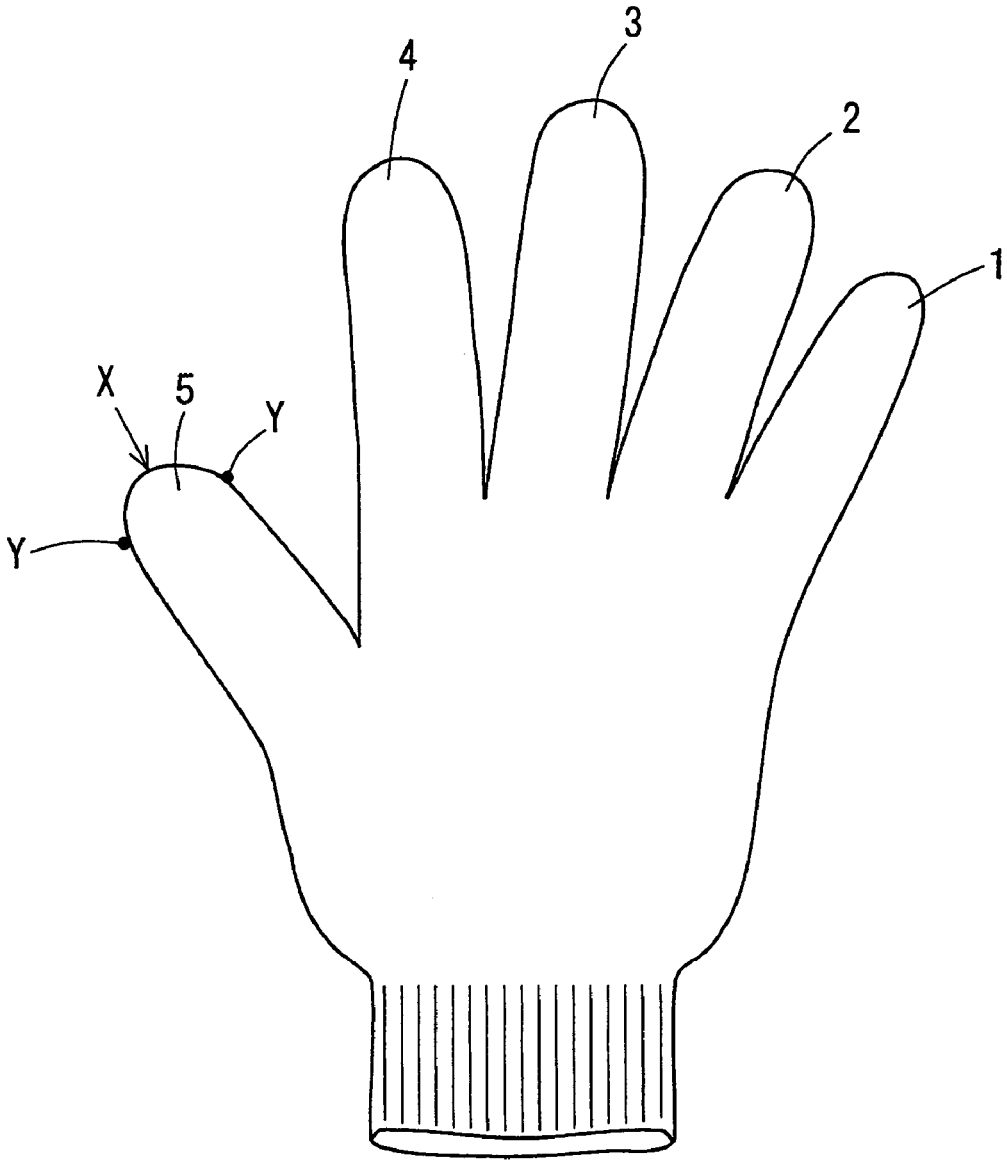
Fig. 7 Prior Art
FIG. 7 is a plan view of a conventional glove.

The second embodiment of the present invention will be described referencing the drawings. FIG. 4 illustrates a glove that is knit with the knitting method of the present invention. FIG. 5 and FIG. 6 are knitting process diagrams illustrating the knitting order for knitting together the glove of the second embodiment. Now, according to the present embodiment, broad rib knitting is performed wherein an empty needle for transferring stitches is located between the needles that are used to form the loops, but FIG. 5 and FIG. 6 illustrate only needles that are used to form the loops, and the needles that are used for transferring stitches and that are located between the needles used for forming the loops are omitted from the diagram.

The second embodiment illustrates an example of a glove that is a 7-gauge medium size, and the finger tube of the little finger 1 is knit using nine needles on each needle bed (18 needles together with the front and back needle beds), the ring finger 2 is knit using nine needles on the front needle bed and ten needles on the back needle bed (19 needles together with the front and back needle beds), the middle finger 3 is knit using ten needles on each needle bed (20 needles together with the front and back needle beds), the index finger 4 is knit using eleven needles on the front needle bed and ten needles on the back needle bed (21 needles together with the front and back needle beds), and the thumb 5 is knit using eleven needles on each needle bed (22 needles together with the front and back needle beds).

Now, the odd-numbered needles on the front bed (FB) are used to form the loops, and the even-numbered needles on the back bed (BB) are used to form the loops.

First, the finger tubes of the little finger 1, the ring finger 2, the middle finger 3, and the index finger 4 are knit. The knit fabric of each finger tube is knit of the front side fabric on the palm side on the knitting needles of the front bed (FB), and of the back side fabric on the back of the hand side on the knitting needles of the back bed (BB). Then, when the knitting of each finger tube is completed, the result is the state illustrated in Step 1 of FIG. 5. The edge portions of the adjacent fabric of each of the front side knit fabric and the back side knit fabric of the little finger 1, the ring finger 2, the middle finger 3, and the index finger 4 are retained on the knitting needles so as to have one needle open, as illustrated in FIG. 5.

Then, as illustrated in Step 2, the knitting of the adjoining portions between the finger tubes of the ring finger 2, the middle finger 3, and the index finger 4 is performed. The adjoining portions between the finger tubes are knit by increasing stitches on the empty needles between the front side knit fabric on the front needle bed (odd-numbered needles) and on the empty needles between the back side knit fabric on the back needle bed (even-numbered needles), and at the same time continuously knitting one course of the back side knit fabric in the order of the index finger 4, the middle finger 3, and the ring finger 2, thus forming the adjoining portion A between the index finger 4 and the middle finger 3, and the adjoining portion B between the middle finger 3 and the ring finger 2 that have a gore.

From this state, one course is knit one full turn so that the connected index finger 4, middle finger 3, and ring finger 2 becomes one tube, and knitting of the three-finger tube 6 illustrated in Step 3 begins. In the state of Step 3, the three-finger tube 6 is in the state of being retained onto 32 needles on each of the front and back beds.

With the configuration of the three-finger tube 6 of Step 3, the finger tubes of the index finger 4, the middle finger 3, and the ring finger 2 are in the state of being connected to the three-finger tube 6.

Further, in between Steps 3 and 4, the stitches of the index finger 4 and the stitches of the middle finger 3 are each moved toward the side of the ring finger 2, and at the boundary of the index finger 4 and the middle finger 3, the stitches are decreased by four, and at the boundary of the middle finger 3 and the ring finger 2, the stitches are decreased by four, and the knitted three-finger tube 6 results in the state illustrated in Step 4, of being retained onto 24 needles on each of the front and back beds.

Specifically, first, all of the stitches of the middle finger 3 and the index finger 4 plus two increased stitches are transferred from the front needle bed to empty needles on the back needle bed, and the back needle bed is racked to the right direction, and the increased stitches formed between the ring finger 2 and the middle finger 3 are transferred so as to stack onto the stitches on the edge portion of the ring finger 2. Further, the back needle bed is racked to the right direction, and all of the stitches that have been transferred to the empty needles on the back needle bed are transferred to the knitting needles on the front needle bed, and the stitches on the edge portion of the middle finger 3 are stacked onto the stitches on the edge portion of the ring finger 2.

Next, with regard to the back needle bed, all of the stitches of the middle finger 3 and the index finger 4 plus two increased stitches are transferred to empty needles on the front needle bed, and the back needle bed is racked to the left direction, and the increased stitches formed between the middle finger 3 and the ring finger 2 are transferred so as to stack onto the stitches on the edge portion of the middle finger 3. Further, the back needle bed is racked to the left direction, all of the stitches of the middle finger 3 transferred to the empty needles of the front needle bed are transferred to needles of the back needle bed, and the stitches on the edge portion of the middle finger 3 are stacked onto the stitches on the edge portion of the ring finger 2. Further, the stitches on the ring finger 2 side portion of the three-finger tube 6 that have been transferred to the empty needles of the front needle bed are transferred to the back needle bed.

Further, the back needle bed is racked to the left, and the increased stitches formed between the middle finger 3 and the index finger 4 that have been transferred to the empty needles of the front needle bed are transferred to the knitting needles of the back needle bed, and the increased stitches are stacked onto the edge portion of the middle finger 3, and the stitches of the ring finger 2 side edge portion of the three finger tube 6 on the front needle bed are transferred to the empty needles on the back needle bed.

Then, the back needle bed is racked to the left, and all of the stitches of the index finger 4 that have been transferred to the empty needles of the front needle bed are transferred to the knitting needles of the back needle bed, and the stitches of the edge portion of the index finger 4 are stacked onto the stitches of the edge portion of the middle finger 3.

Next, all of the stitches of the index finger 4 and the increased stitches that are formed between the middle finger 3 and the index finger 4 that are retained on the knitting needles of the front needle bed are transferred to the empty needles on the back needle bed, and the back needle bed is racked to the right, where the increased stitches are stacked onto the stitches of the edge portion of the middle finger 3, and the stitches of the edge portion on the side of the ring finger 2 of the three-finger tube 6 that have been transferred to the empty needles of the back needle bed are transferred to the knitting needles on the front needle bed.

Further, the back needle bed is racked to the right, and all of the stitches that have been transferred to the empty needles of the back needle bed are transferred to the knitting needles of the front needle bed, and the stitches on the edge portion of the index finger 4 are stacked onto the edge portion of the middle finger 3.

Thus, one course is knit on the front and back beds in the state of four stitches being decreased. Further, similar to the description above, one course is knit with four stitches decreased, resulting in the state of Step 4.

Next, as illustrated in Step 5, the adjoining portion C between the three-finger tube 6 and the little finger 1 is knit together. In this case also, similar to the description above, the adjoining portion C that has a gore is knit by continuously knitting one course of the back side knit fabric in the order from the three-finger tube 6 to the little finger 1, while increasing stitches on the empty needles between the back side knit fabric on the back needle bed and on the empty needles between the front side knit fabric on the front needle bed.

From this state, one course is knit one full turn so that the connected three-finger tube 6 and the little finger 1 become one tube, and the four-finger tube 7 illustrated in Step 6 begins to be knit. In the state of Step 6, the four-finger tube 7 is in the state of being retained onto 34 needles on each of the front and back beds.

With the configuration of the four-finger tube 7 of Step 6, the three-finger tube 6 and the little finger 1 are in the state of being connected.

Further, after the knitting of the four-finger tube 7 is performed, the thumb tube of the thumb 5 is to be knit, and the tubular knit fabric of the thumb 5 and the tubular knit fabric of the four-finger tube 7 are knit in the state wherein every other knitting needle on each of the front and back needle beds is left empty, and this results in the state of Step 7 as illustrated in FIG. 6.

Next, as illustrated in FIG. 8, the knit fabric of the thumb tube of the thumb 5 that is retained on the knitting needles is to be turned, and in the second embodiment, the stitches on the edge portion of the knit fabric that are retained on each bed of the stitches of the knit fabric of the thumb 5 are transferred to the knitting needles of the facing bed, and by repeating the racking operation of the back needle bed a certain number of pitches, the turning operation is performed.

Now, in the final course illustrated in Step 7, in which the thumb tube of the thumb 5 is knit, loops of a number equal to the number of stitches to be turned are knitted being twisted in advance so as to resolve the twisting when the stitches are transferred.

Further, the turning operation is performed in the range of one-quarter turn or less in the direction wherein the stitch that is farthest from the four-finger tube 7 on the thumb 5 is turned into (toward) the palm side. With the present embodiment, a one-quarter turn is made, and in FIG. 6 a turn of six needles worth is made.

Now, the turning operation of the thumb 5 is preferably turned in the range of three-twentieths of a turn to one-quarter of a turn in the direction wherein the stitch that is farthest from the four-finger tube 7 on the thumb 5 is turned into (toward) the palm side, from the state before the four-finger tube 7 and the thumb tube of the thumb 5 are connected.

Next, as illustrated in Step 9, the adjoining portion D between the four-finger tube 7 and the thumb tube 5 is knit together. The adjoining portion D that has a gore is knit by continuously knitting one course of the back of the hand side knit fabric in the order from the thumb 5 to the four-finger tube 7, while increasing stitches on the empty needles between the back side knit fabric of the thumb 5 and the four-finger tube 7 on the back needle bed and on the empty needles between the front side knit fabric of the thumb 5 and the four-finger tube 7 on the front needle bed, and the needles on both sides of the needles of the increased stitches are each tacked down.

Further, after completion of Step 9, as illustrated in Step 10, the stitches on either side are transferred onto the needles wherein stitches have been increased (the position indicated by a *), and all of the stitches are transferred to the adjacent needles so as to stack two stitches onto the increased stitches.

After transferring, as illustrated in Step 11, one course is knit across the front and back beds. Further, as illustrated in Step 12, stitches on either side are transferred to the needles wherein stitches have been increased, and all of the stitches are transferred to the adjacent needles so as to stack two stitches onto the increased stitches. Then, as illustrated in Step 13, one course is knit across the front and back beds, and the adjoining portion D is completed. In the state of Step 13, the five-finger tube 8 is in the state of being retained onto 42 needles on each of the front and back beds.

From the knitting together of the five-finger tube 8 of Step 9 through Step 13, the four-finger tube 7 and the thumb tube of the thumb 5 are connected, and the four-finger tube 7 and the thumb tube of the thumb 5 are continuously knit to the five-finger tube 8.

Then, from Step 13, after the four-finger tube 7 and the thumb tube of the thumb 5 are connected, the knitting width of the five-finger tube 8 is decreased.

The knitting to decrease the knitting width of the five-finger tube 8 is performed by decreasing the knitting width while stacking the stitches of the thumb side edge portion on the five-finger tube 8 with each predetermined course and the five-finger tube 8 is knit together, wherein the knitting of the five-finger tube 8 is completed in the state of Step 14.

Then, the wrist portion is knit with a rib knitting continuously from the five-finger tube 8, and the knitting of the glove is completed.

The glove of the second embodiment, as described above, is knit together to connect the thumb 5 and the four-finger tube 7 after the stitches of the thumb 5 are turned one-quarter turn. Therefore, as illustrated in FIG. 4, the stitches on the fingertip portion of the thumb tube of the thumb 5 are continuously knit onto the five-finger tube 8 in the state of being turned one-quarter turn.

As a result, by the turning operation of the thumb 5, the knot portion Y on both edges of the fingertip curve line X that is formed at the beginning of knitting of the thumb tube of the thumb 5 does not coincide with the underside of the thumb when the glove is worn, and any discomfort while wearing the glove is eliminated, and productivity can be increased.

Now, of the above-described embodiments, with a glove, the knitting of the adjoining portions between the index finger and the middle finger, and between the middle finger and the ring finger, and between the ring finger and the little finger can be performed with the knitting method illustrated in Step 2 of FIG. 5, and the knitting of the adjoining portion between the thumb and the four-finger tube can be performed with the knitting method illustrated in Step 9 of FIG. 6. However, the knitting together of each adjoining portion in the instance of knitting together a glove is not limited to the above-described embodiments, and in the case of taking a smaller gore of the adjoining portion, the adjoining portion is knit together with the knitting method illustrated in Step 2 of FIG. 5, and in the case of taking a larger gore of the adjoining portion, the adjoining portion is knit together with the knitting method illustrated in Step 9 of FIG. 6.

Further, while the glove of the second embodiment has been described as a work glove, the tubular knit fabric of the present invention and the knitting method thereof are not limited to a five-fingered glove, and can also be applied to a fashion type glove. Further, the knitting method can also be applied to a so-called mitten type glove.

According to the above-described second embodiment, the turning operation is performed at the point where the portion that the knit fabric of the thumb tube of the thumb 5 is knitted and connected to the four-finger tube 7, but the turning operation can be performed anytime after the fingertip curve line X is finished being formed that is formed at the beginning of knitting the thumb 5, until the four-finger tube 7 is connected.

Thus, with the first embodiment and with the second embodiment, the turning operation of the tubular portion that has directionality (the glove portions 91*a* and 91*b* in the first embodiment, and the fingertip curve line X of the thumb tubes of the thumb 5 in the second embodiment) towards the predetermined tubular portion (the sleeve portions 92 and the front and back bodices 93*a* and 93*b* in the first embodiment, and the four-finger tube 7 in the second embodiment) can be performed from the time that the tubular portion that has directionality is completely formed until connected to the other tubular portion (the sleeve portions 92 and the front and back bodices 93*a* and 93*b* in the first embodiment, and the four-finger tube 7 in the second embodiment).

Further, the knit garment of the first embodiment can be knit together so that the glove portions 91*a* and 91*b* are knit as conventional gloves that can be used for either right or left hand, and the thumb tube of the thumb can be turned and knit as in the above-described second embodiment.

Further, the shape of the gloves of the knit garment of the first embodiment can be shaped not only as a five-fingered glove, but also as a so-called mitten type glove, or a fingerless type glove wherein the fingertips are cut off.

Further, while the knit garment of the first embodiment has been described as a sweater, the present invention can be applied to any long sleeved knit garment such as a cardigan.

Further, with the above-described embodiments, knitting of the knit fabric is performed by plain knitting, but the present invention can be applied to other knitting stitches such as rib knitting or patterns.

The invention claimed is:

1. A method of knitting tubular knit fabric in which multiple tubular portions are knitted and connected using a flat-knitting machine including at least one pair of facing needle beds extending in the sideways direction and facing each other front to back, at least one of the facing needle beds being capable of racking in the sideways direction, and the flat-knitting machine being capable of transferring stitches between the facing needle beds, said method comprising:

knitting a first tubular portion and a second tubular portion so that the first tubular portion has a first orientation with respect to the second tubular portion;

turning the first tubular portion having the first orientation by a predetermined amount by transferring stitches of the first tubular portion and by racking of the needle bed so that a stitch of the first tubular portion farthest from the second tubular portion is transferred, whereby the first tubular portion is turned toward the second tubular portion and has a second orientation with respect to the second tubular portion; and knitting so as to link the first tubular portion to the second tubular portion while the first tubular portion is held in the second orientation so that the tubular knit fabric is shaped to match a configuration of a human body.

2. The knitting method of claim 1, wherein the first tubular portion comprises a glove portion and the second tubular portion comprises a body portion, said turning comprising turning the glove portion so that a thumb of the glove portion faces a front side of the body portion of a knitted garment by said racking of the needle bed and said transferring of the stitch immediately following knitting of the glove portion to empty needles, and said knitting so as to link the first tubular portion to the second tubular portion comprising continuously knitting the glove portion, the body portion, and a sleeve portion after said turning so as to form the knit garment.

3. The knitting method of claim 1, wherein the first tubular portion comprises a thumb portion and the second tubular portion comprises a four-finger portion, said turning comprising turning the thumb portion no more than one quarter turn by said racking of the needle bed and said transferring of the stitch by which the thumb portion has been knit to empty needles, and said knitting so as to link the first tubular portion to the second tubular portion comprising, after said turning, knitting to connect the thumb portion and the four-finger portion to a five-finger tube portion.

4. A tubular knit fabric comprising:

multiple tubular portions knitted and connected using a flat-knitting machine including at least one pair of facing needle beds extending in the sideways direction and facing each other front to back, at least one of the facing needle beds being capable of racking in the sideways direction, and the flat-knitting machine being capable of transferring stitches between the facing needle beds, said tubular portions including:

a first tubular portion and a second tubular portion knitted so that the first tubular portion initially has a first orientation with respect to the second tubular portion, the first tubular portion having the initial first orientation being turned by a predetermined amount by transferring stitches of the first tubular portion and by racking of the needle bed so that a stitch of the first tubular portion farthest from the second tubular portion is transferred, whereby the first tubular portion is turned toward the second tubular portion and has a second orientation with respect to the second tubular portion, the first tubular portion being linked to the second tubular portion with the first tubular portion in the second orientation so that the tubular knit fabric is shaped to match a configuration of a human body.

* * * * *